US006367725B1

(12) United States Patent
Goodwin

(10) Patent No.: US 6,367,725 B1
(45) Date of Patent: Apr. 9, 2002

(54) WIRE SPOOLER/DISTRIBUTOR

(76) Inventor: Brian S. Goodwin, 1432 Hopkins Rd., Richmond, VA (US) 23224

( * ) Notice: Subject to any disclaimer, the term of this patent is extended or adjusted under 35 U.S.C. 154(b) by 0 days.

(21) Appl. No.: 09/685,949

(22) Filed: Oct. 12, 2000

(51) Int. Cl.[7] ..... B65H 49/00; B65H 54/22

(52) U.S. Cl. ..... 242/129; 242/127; 242/128; 242/130.2; 242/574.4

(58) Field of Search ..... 242/128, 129, 242/127, 573.9, 574.4, 130.2

(56) References Cited

U.S. PATENT DOCUMENTS 1,242,657 A * 10/1917 Coburn ..... 242/474.4
3,017,136 A * 1/1962 Noffke ..... 242/129
3,729,092 A * 4/1973 Marcell ..... 242/129 X
3,974,980 A * 8/1976 Marcell ..... 242/128
4,132,372 A 1/1979 Worrell
4,471,921 A 9/1984 Corbin
4,856,729 A * 8/1989 Maraman ..... 242/129
5,007,597 A 4/1991 Jones
5,261,625 A 11/1993 Lanoue
5,348,241 A 9/1994 Huette
5,551,647 A 9/1996 Browning
5,752,670 A 5/1998 Lasecki et al.
5,918,831 A * 7/1999 Floyd, Sr. et al. ..... 242/129 X

* cited by examiner

*Primary Examiner*—Michael R. Mansen
(74) *Attorney, Agent, or Firm*—Richard C. Litman

(57) ABSTRACT

A wire spooler/distributor for dispensing electrical wire during the installation of electrical wiring at a construction site. The wire distributor of the present invention is lightweight and portable and easy to transport from one location to another. The wire spooler distributes electrical wire from a suspended location at the construction site. The wire spooler/distributor has a rotating central shaft with a plurality of retractable spokes defining a conical frame about which a coil of wire may be spooled.

13 Claims, 3 Drawing Sheets

WIRE SPOOLER/DISTRIBUTOR

BACKGROUND OF THE INVENTION

1. Field of the Invention

The present invention relates generally to wire spoolers and more particularly, to a wire spooler/distributor that is used to distribute electrical wire from a suspended location at a construction site.

2. Description of the Related Art

Distributing electrical wiring at a construction site is frequently very frustrating because the wiring often becomes tangled as it is unspooled from where is stored to where it is used. Constantly having to stop work to untangle tangled wire is very disruptive and counterproductive to completing the job in a timely fashion. Furthermore, carrying a bulky coil of wire from one location to another at a construction site is both laborious and dangerous because a worker's attention is momentarily distracted as he moves the coiled wire from one location to another. The alternative of using an apparatus that is fastened to the floor to prevent the coil of wire from sliding across the floor when the wire is pulled is ineffective because a suitable fastening point must be located, and because repeated fastening and unfastening of the apparatus is required to complete the job, which is inconvenient and time-consuming.

Having an efficient way to distribute electrical wiring during the installation of electrical wiring in a building under construction saves both time and money because wire is wasted when too much wire is inadvertently pulled off the spool of wire. Excess wire is cut and discarded because it is much simpler for the electrician or construction worker to dispose of the excess wire than to rewind it at the end of each installing operation, a process which is both difficult and time-consuming. Frequently, to overcome this inefficient distribution of electrical wire, multiple coils of wire are used in an attempt to eliminate the need to carry a coil of wire from one location to another on a construction site. However, this approach simply creates another problem because the wires from the different spools can become entangled. Many attempts have been made to alleviate these problem, however, they frequently involve expensive and heavy apparatuses that do not function in an efficient manner.

The prior art is replete with spooling mechanisms used to dispense a wide variety of wiring. For example, a reel wire dispenser is described in U.S. Pat. No. 4,471,921, issued on Sep. 18, 1984 to N. J. Corbin. The portable wire dispenser has a rotatable reel attached to a base. The base surrounds the reel with a case to prevent the wire from uncoiling after it is pulled off the reel. A rigid pivot post is mounted to the base and extends upward.

U.S. Pat. No. 4,132,372, issued on Jan. 2, 1979 to M. H. Worrell, describes a cable holder and dispenser. The holder and dispenser of cable wire, such as ROMEX cable, is designed to hang from rafters. The dispenser includes a cable reel holding frame, a swivel that allows the frame to rotate, a vertical telescoping strap support on which the swivel and the frame hang, and an inverted U-shaped portion that attaches to a rafter.

An automatic dispenser for elongated flexible coiled elements is described in U.S. Pat. No. 5,007,597, issued on Apr. 16, 1991. The automatic dispenser is design to accommodate elongated flexible elements such as wire, string, rope, and flat steel. The automatic motorized dispenser employs a pair of guide members to control the rate of dispensing of the elongated flexible element.

U.S. Pat. No. 5,261,625, issued on Nov. 16, 1993 to M. Lanoue, describes a device f or dispensing wire or cable. The device is a box within which is mounted a reel having a supply of wire or cable to be dispensed. An opening is provided in one of the walls of the box to allow the egress of one end of the strand. A cover securely contains the reel within the box. Mounted within the box is a brake device which has a portion slidingly contacted by the strand prior to egressing from the box.

A ROMEX wire dispenser is described in U.S. Pat. No. 5,348,241, issued on Sep. 20, 1994 to D. M. Huette. The ROMEX wire dispenser contains rotatable radius bars adapted to accept a complete 250 foot reel of coiled wire. The bars are rotatably mounted upon a spindle mounting assembly that is fixedly attached to an arm connecting a pair of spaced apart U-shaped members. The U-shaped members are each adapted to fit over opposite sides of a 2×4 stud member to hold the spindle mounting assembly in a given position when hooked over a stud member.

A cable storage and feeding device is described in U.S. Pat. No. 5,551,647, issued on Sep. 3, 1996 to T. D. Browning. The portable cable feeding or dispensing device has a base adapted to be placed and to rest firmly on the floor or the ground or some other support. Stanchions are affixed to the base and extend in a generally normal direction. A spool having a hub, a pair of opposed first and second rims, and an axle allows rotational motion that results in the uncoiling and dispensing of a cable.

U.S. Pat. No. 5,752,670, issued on May 19, 1998 to M. R. Lasecki et al., describes a wire dispenser with a retractor. The coiled material dispenser has an automatic spring retractor that respools wire after a portion of the material has been removed. The dispenser is suspended at or near a work station where a portion of such material is required to be unspooled and removed for use. The spring rewinder automatically retracts at least a portion of the excess material back onto the spool.

None of the above inventions and patents, taken either singularly or in combination, is seen to describe the instant invention as claimed. Thus a wire spooler/distributor solving the aforementioned problems is desired.

SUMMARY OF THE INVENTION

Accordingly, it is a principal object of the invention to provide a wire spooler to distribute wire that is portable, lightweight, and easily transported from one location to another location.

It is another object of the invention to provide a wire spooler to distribute wire that is collapsible and readily stored, requiring only a minimal amount of storage space.

It is a further object of the invention to provide a wire spooler to distribute wire that has a cone shaped configuration when operational which allows for easy dispensing and distributing of wire.

Still another object of the invention is to provide a wire spooler to distribute wire that can be conveniently suspended from a rafter or joist so that the spooler can be located near where it is needed.

It is an object of the invention to provide improved elements and arrangements thereof for the purposes described which is inexpensive, dependable and fully effective in accomplishing its intended purposes.

The foregoing objectives are achieved in accordance with the present invention by providing a portable wire spooler that smoothly and efficiently distributes wire without tangling during the installation of electrical wiring at residential and commercial construction sites. The wire spooler of the present invention has a unique and innovative collapsible cone shaped configuration that allows the spooler to be both conveniently set up for use and collapsed for storage. The wire spooler of the present invention has a stationary upper frame and a movable lower frame that is capable of circular rotation relative to the upper frame.

The wire spooler employs a mechanism similar to that used in an umbrella to extend and retract the spokes around which a wire is wrapped. The cone shape configuration of the spooler endows the spooler with the proper rotational dynamics that allows for a smooth and even dispensing of the coiled wire.

The wire spooler of the present invention is lightweight and easy to transport from one location to another location, or from one job to another job. The wire spooler consists of a central rod, a sliding shaft disposed on the central rod, four spokes that are pivotally connected to the central rod and sliding shaft, and a hanger at the top of the central rod for hanging the spooler from the ceiling. The wire spooler is suspended from a ceiling rafter or joist.

The wire spooler of the present invention reduces installation costs by eliminating costs associated with wire oversupply. The wire spooler is mounted in one location and wire is pulled by the user to nearby and distance locations without having to move the spooler and without the spooler inadvertently moving across the floor. The wire spooler of the present invention significantly enhances the efficiency of installing electrical wiring during construction of a building.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
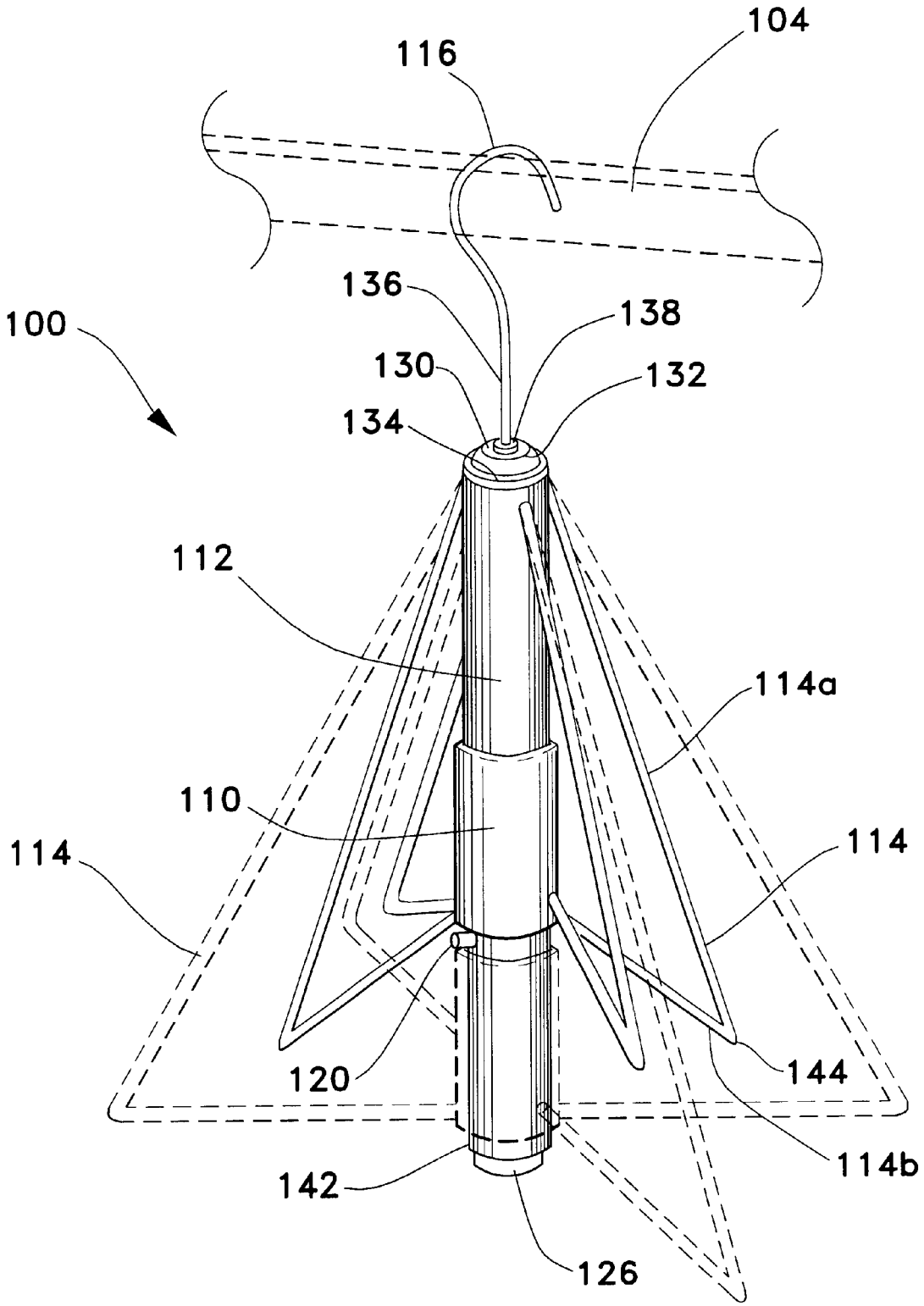
FIG. 1 is an environmental, perspective view of a first embodiment of a wire spooler/distributor according to the present invention hanging from a ceiling joist.
Figure 2:
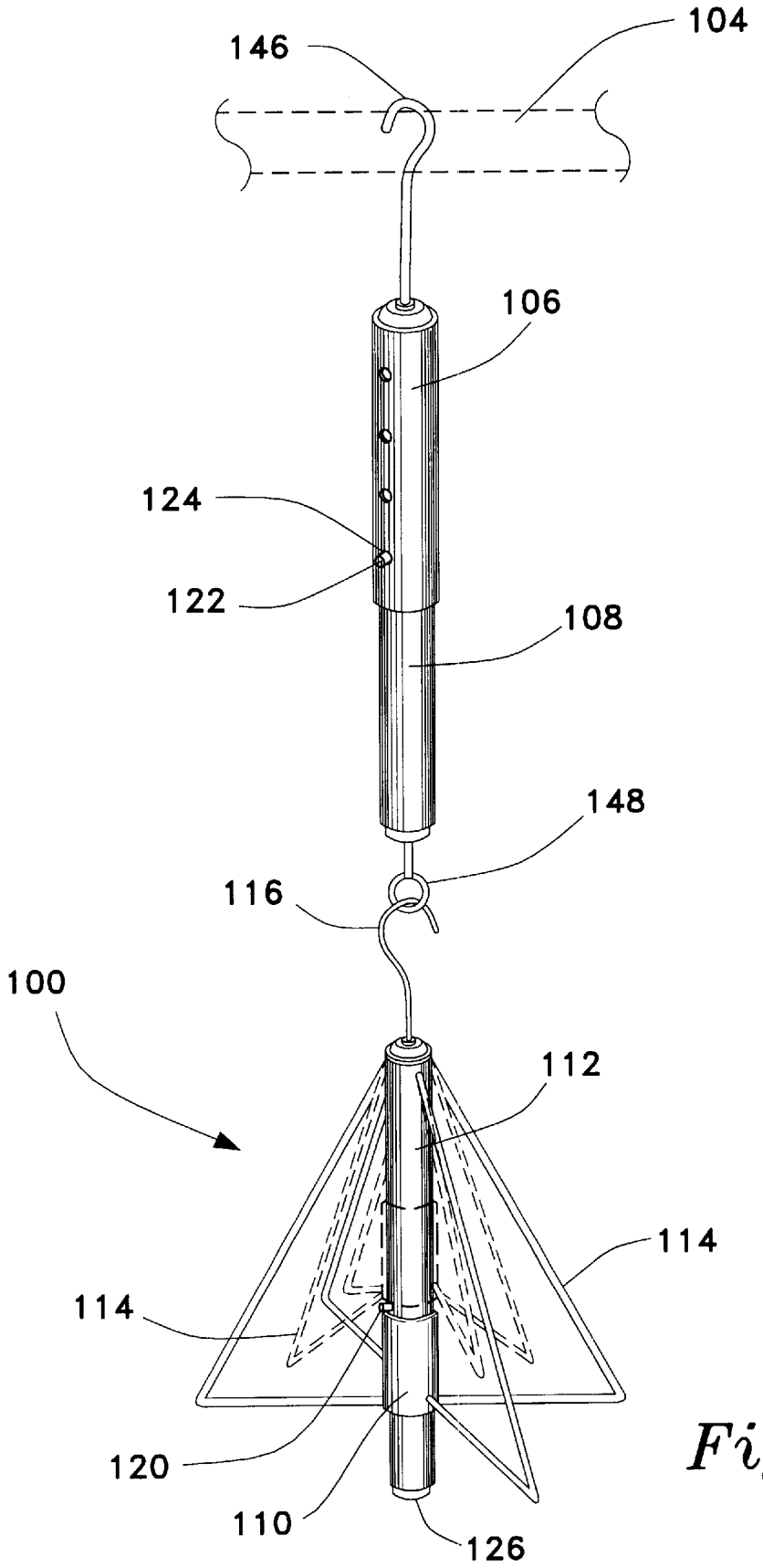
FIG. 2 is an environmental, perspective view of a second embodiment of a wire spooler/distributor with adjustable hanging rods suspended from a ceiling joist.
Figure 3:
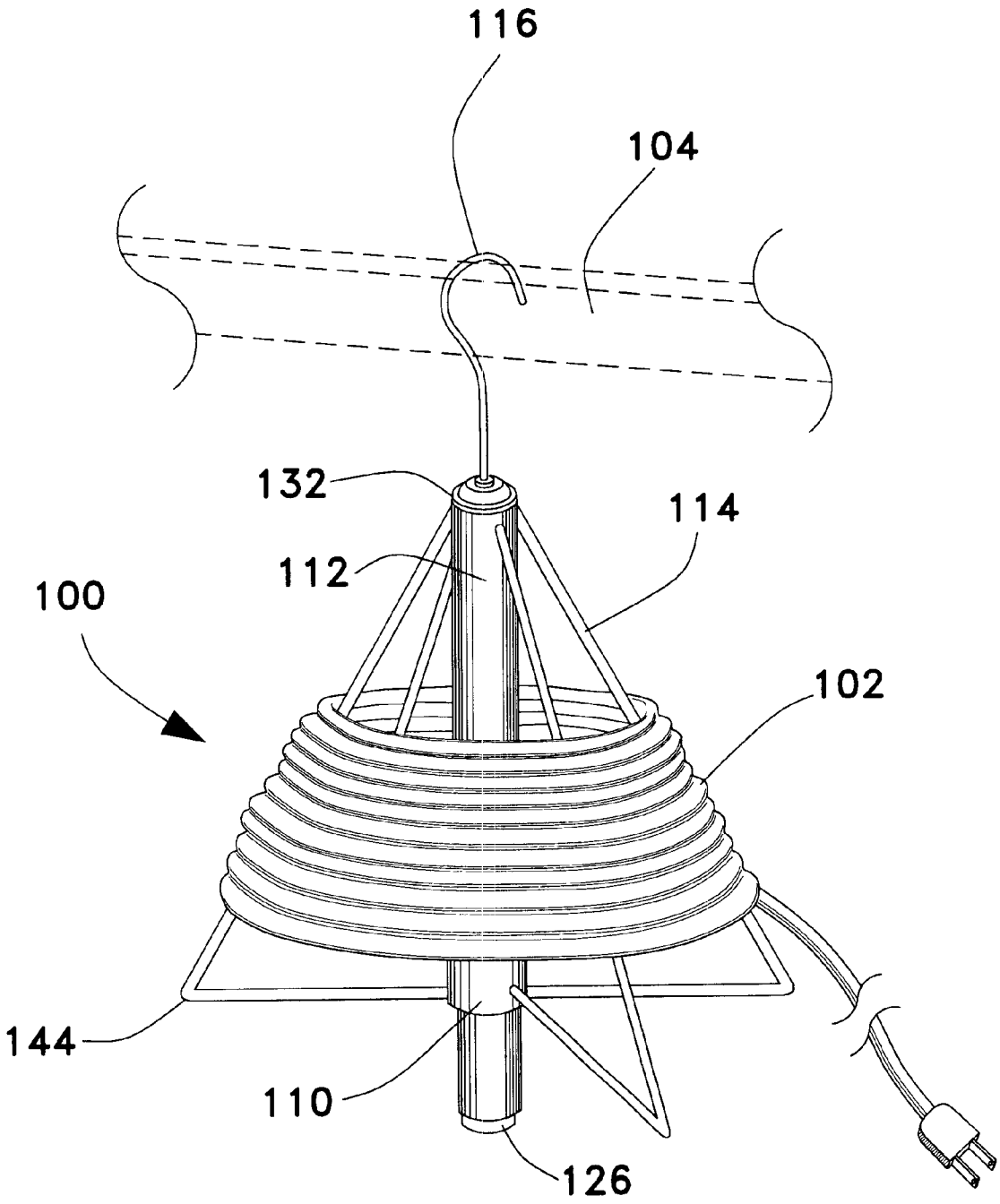
FIG. 3 is an environmental, perspective view of the first embodiment of the wire spooler/distributor suspended from a ceiling joist with electrical wire to be distributed wrapped around the wire spooler.

The present invention, as depicted in FIGS. 1–3, is a wire spooler/distributor 100 that is used to easily and efficiently distribute electrical wire 102 at a construction site. Wire 102, such as electrical wire 102, is wrapped around the wire spooler 100 as shown in FIG. 3. A spindle 132 allows the hollow central cylindrical shaft 112 of the wire spooler 100 to rotate freely around the upper stationary hub 130 of the wire spooler 100. The wire spooler 100 allows an electrician or electrical contractor to conveniently and readily install cable from junction box to junction box to switch and finally to the circuit breaker or fuse box and the main line. Wire spooler 100 is designed to allow electricians working within a building structure to install the electrical wiring system in an efficient and convenient fashion.

FIG. 1 is an environmental, perspective view of a first embodiment of a wire spooler/distributor 100 hanging from a ceiling rafter or joist 104. The wire spooler 100 is conveniently hung from an exposed rafter or joist 104 which is readily available because typically in a home or building under construction, completing the flooring or interior paneling, the ceilings, and the necessary plastering are done during the final stages of the construction job after installation of the electrical wiring, outlet boxes, switch boxes, etc. When the wire spooler 100 is hung from a joist 104, the wire spooler 100 should hang from 4 to 6 feet above the finished floor, which is a height that allows for comfortable operation of the spooler 100 by a user.

The wire spooler 100 can be easily stored by retracting the collapsible spokes 114 in a manner very similar to the closing of an umbrella. Each spoke 114 has a first leg 114*a* comprising a rod having one end pivotally attached to an upper portion of central cylindrical shaft 112, a second leg 114*b* comprising a second rod having one end pivotally attached to slidable sleeve 110, and a retractable pivot corner 144 joining the opposite ends of first leg 114*a* and second leg 114*b*. The wire spooler 100 is opened and closed by moving the sliding sleeve 110 down or up as shown in FIG. 1. A spring biased, push-in locking button 120 prevents the sliding sleeve 110 from moving up or down once the wire spooler spokes 114 have been either extended (shown in phantom in FIG. 1) or retracted.

A spindle mechanism 132 allows the central shaft 112 to rotate freely relative to the stationary hub 130 of the wire spooler 100 used to hang the spooler 100 to a joist 104. The stationary hub 130 of the wire spooler 100 has a hooked shaped joist or rafter hanger 116 that extends through an opening 138 in the stationary portion 130 of the wire spooler 100. The joist hanger 116 is approximately 6 inches in length, however, the length of the joist hanger 116 is scaled to accommodate the specific size of the wire spooler 100. The wire spooler 100 has an end cap 126 disposed at the end 142 of the central shaft 112 distal to the hanger or hook 116.

In the embodiment shown in FIG. 1, the joist hanger 116 is designed so that the lower portion 136 of the hanger 116 resides within the central cavity 134 of the wire spooler 100 when the wire spooler 100 is not hung from a joist 104. The hanger 116 easily slides up and down through an opening 138 in the stationary hub 130 of the wire spooler 100. When the wire spooler 100 is hung from a joist 104, the weight of the spooler 100 causes the downward displacement of the spooler 100 relative to the hanger 116 until a stop (not shown) at the distal end of the straight portion of the hanger 116 brings the spooler 100 to its resting and operational position as shown in FIG. 1.

When the wire spooler 100 is not in use, the hanger 116 is disposed primarily within the central cavity 134 of the spooler 100 with the curvature of the hanger 116 preventing the hanger 116 from descending any further into the central cavity 134 of the spooler 100. The collapsible mechanism of the spooler 100 allows the spokes 114 to lie flat against the central shaft 112. The innovative design of the wire spooler 100 allows for a compactness when closed so that the wire spooler 100 requires a minimal amount of storage space.

In a preferred embodiment, the thin rods that make up the spokes 114 are ¼"0 in diameter. The wire spooler 100 has an operational length when hung from a joist of approximately 2–2½ feet and a maximum diameter when open of approximately thirty inches. In the preferred embodiment, the central shaft 112 has an inner diameter of approximately 1 to 1½" and the wire spooler 100 is made of aluminum, however, any suitable strong but lightweight material could be used. The lightweight material must be able to withstand at least 35 lbs of wire coils of sizes 14/3, 14/2, 12/3, 12/2, 10/3, 10/2 of ROMEX coils of 250 ft.

The wire spooler 100 of the present invention allows the construction worker to wrap a supply of wire, such as electrical wire, around the spooler, and to transport the wire spooler 100 to the location where the wiring job is to be done, hanging the wire spooler from one of the available joists, and conveniently unspooling the necessary wire needed to do the job. If more wire than is needed is accidentally pulled off the wire spooler 100, the excess wire is easily respooled on to the wire spooler 100.

FIG. 2 is an environmental, perspective view of a second embodiment of a wire spooler/distributor 100 with adjustable hanging rods 106,108 suspended from a ceiling joist 104. In this embodiment, the wire spooler 100 is hung from adjustable, telescoping rods 106,108 that allow the spooler 100 to be hung in rooms with high rafters or joists 104. Rod 106 is hollow and has an inner diameter slightly smaller than the outer diameter of rod 108 so that rod 108 is slidably within rod 106. The adjustable rods 106,108 allow the construction worker to hang the wire spooler 100 at recommended heights without heavy lifting above the height of the user's head. In a preferred embodiment, the upper adjustment rod 106 is approximately 2 feet in length and the lower adjustment rod 108 is approximately 2 feet in length. The operational length of the adjustment rods 106,108 ranges from approximately 2 to 4 feet. However, the lengths of the upper and lower adjustment rods 106,108 and their composite length can be varied to meet the specific needs of the user.

The adjustable rods 106,108 have a hook or hanger 146 disposed at one end and an o-shaped ring 148 disposed at the opposite end. The rod hanger 146 in this embodiment is hung on the joist 104 and the wire spooler hanger 116 is inserted into and hung from the o-shaped ring 148 of the adjustable rods 106,108. The o-shaped ring 148 allows for easy hanging of the wire spooler 100. The rod hanger 146 is approximately 8" in length and the o-shaped ring 148 has an inner diameter of 1½".

The adjustable rods 106,108 employ a pin 122 to change the length of the rods. Each rod 106,108 has holes 124 medially disposed lengthwise along the rod 106,108. The holes 124 of the respective rods 106,108 are aligned and the pin 122 is placed into the appropriate aligned holes 124 that produces the desired length. Therefore, the adjustable rods 106,108 allow the construction worker to maintain the wire spooler 100 at a comfortable height even when the height of the joist 104 prevents the spooler 100 when hung directly over the joist 104 to hang at a comfortable height. Furthermore, with the adjustable rods 106,108, there is no need for a construction worker to climb a ladder to put wire 102 on the spooler 100 or to take wire 102 off the spooler 100.

FIG. 3 is an environmental, perspective view of the first embodiment of the wire spooler/distributor 100 suspended from a ceiling joist 104 with electrical wire 102 to be distributed wrapped around the wire spooler 100. The wire 102 to be dispensed is coiled horizontally around the frame spokes 114. The cone shaped configuration of a fully opened or deployed wire spooler 100 endows the wire spooler 100 with the appropriate rotational dynamics that allow for tangle free unspooling and respooling of wire. The corners 144 of the spokes 114 are rounded to ensure the safety of the user. The problem of wire oversupply is avoided because excess wire 102 is readily rewound back onto the wire spooler 100. The wire spooler 100 is used with a various cable sizes ranging from 250 ft of 14-2 cable to 250 ft of 10-3 cable.

The wire spooler/distributor of the present invention with its compactness of design allows the electrician or construction worker to efficiently install wiring where needed at a construction site. Using the innovative wire spooler/distributor of the present invention, wire is easily pulled from the spooler and distributed around a construction site. The novel wire spooler/distributor of the present invention eliminates the need for construction workers to carry heavy and bulky coils of wire across a construction site as they lay the wires. The wire spooler/distributor of the present invention is especially well-suited for distributing wire in the construction of residential and light commercial buildings.

The preferred embodiments of the present invention disclosed herein are intended to be illustrative only and are not intended to limit the scope of the invention. it should be understood by those skilled in the art that various modifications and adaptations of the present invention as well as alternative embodiments of the present invention may be contemplated. It is to be understood that the present invention is not limited to the embodiments describe above, but encompasses any and all embodiments within the scope of the following claims.

I claim:

1. A wire distributor for dispensing electrical wire spooled about the distributor, comprising:

a stationary hub having an opening defined therein;

a hollow central cylindrical shaft rotatably disposed about said stationary hub and having an upper portion;

an attachment means for attaching said stationary hub to an elevated stationary location so that the stationary hub is suspended from the elevated location;

a sleeve slidably disposed about said central cylindrical shaft;

a plurality of spokes radially disposed about said central cylindrical shaft, each spoke including a first leg having a first end pivotally attached to the upper portion of said central shaft and having a second end, a second leg having a first end pivotally attached to said sleeve and having a second end, and a retractable, pivoting corner formed by the junction of the seconds ends of said first and second legs; and a retractable button disposed in said central cylindrical shaft, the button precluding sliding movement of said sleeve when the button is in an extended position;

wherein said sleeve is slidable between an open position in which said spokes form a conical frame about said central shaft, and a closed position in which said spokes collapse against said central shaft, the conical frame being adapted for receiving electrical wire spooled about the conical frame.

2. A wire distributor according to claim 1, further comprising a spindle mechanism rotatably attaching said central shaft to said stationary hub.

3. A wire distributor according to claim 1, wherein said attachment means comprises a hook attached to said stationary hub.

4. A wire distributor according to claim 3, wherein said hook is slidably disposed in said central shaft for storage when not in use.

5. A wire distributor according to claim 3, wherein said attachment means further comprises a pair of telescoping rods, one of said telescoping rods having a hook at one end for attachment to a stationary location and the other one of said telescoping rods having means for receiving the hook attached to the stationary hub, said pair of telescoping rods further comprising locking means for temporarily locking the length of said telescoping rods.

6. A wire distributor according to claim 1, wherein said spokes have rounded corners.

7. A wire spooler for dispensing wire, comprising:

an elongated hollow cylindrical shaft having a central cavity, the shaft being adapted to be disposed in a vertical position, the shaft having a stationary upper frame and a movable lower frame;

a rotating mechanism for rotating said lower frame relative to said upper frame;

an attachment means for attaching said upper frame to a stationary location;

a plurality of angled spokes attached to said lower frame;

a collapsing mechanism for collapsing the angled spokes attached to said lower frame;

a locking mechanism for locking the angled spokes into place; and an end cap disposed at the terminus of said lower frame;

wherein said lower frame has an elongated central shaft and a shorter movable shaft whereby said movable shaft is concentric with said elongated shaft and whereby said movable shaft moves along the exterior length of said elongated central shaft.

8. A wire spooler according to claim 7, wherein said rotating mechanism is a spindle.

9. A wire spooler according to claim 7, wherein said collapsing mechanism comprises connection of one end of said spokes to said central shaft and connection of the other end of said spokes to said movable shaft.

10. A wire spooler according to claim 7, wherein said attachment means is a hook having a protuberance at one end.

11. A wire spooler according to claim 7, wherein said lower frame has a cone shaped configuration when said angled spokes are extended.

12. A wire spooler according to claim 7, wherein said lower frame has a cylindrical configuration when said angled spokes are retracted.

13. A wire spooler according to claim 7, wherein said angled spokes have rounded corners.

* * * * *